US008032958B2

(12) United States Patent
Pieta et al.

(10) Patent No.: US 8,032,958 B2
(45) Date of Patent: Oct. 11, 2011

(54) SWADDLING BLANKET, PATICULARLY FOR USE IN CONNECTION WITH PREMATURE INFANTS, AND METHOD OF USING THE SAME

(76) Inventors: Anna Pieta, Mount Prospect, IL (US); Teresa Ciesielski, Kenilworth, IL (US)

( * ) Notice: Subject to any disclaimer, the term of this patent is extended or adjusted under 35 U.S.C. 154(b) by 93 days.

(21) Appl. No.: 12/588,369

(22) Filed: Oct. 14, 2009

(65) Prior Publication Data

US 2011/0083276 A1 Apr. 14, 2011

(51) Int. Cl.
*A47G 9/02* (2006.01)

(52) U.S. Cl. ..... 5/494; 5/482; 5/655; 2/69.5

(58) Field of Classification Search ..... 5/413 R, 5/482, 494, 603, 655; 2/69.5; D2/719
See application file for complete search history.

(56) References Cited

U.S. PATENT DOCUMENTS

| | | | | |
|---|---|---|---|---|
| 1,583,419 | A | 5/1926 | Perl | |
| 1,584,853 | A | 5/1926 | Dern | |
| 2,227,751 | A | 1/1941 | Idelman | |
| 3,412,407 | A | 11/1968 | Key | |
| 3,477,065 | A | 11/1969 | Hoover | |
| 4,979,250 | A | 12/1990 | Troncone et al. | |
| 5,063,912 | A | 11/1991 | Hughes | |
| 5,692,257 | A | 12/1997 | Albertieri | |
| 5,722,094 | A | 3/1998 | Ruefer | |
| 5,781,946 | A | 7/1998 | McEntire et al. | |
| 5,950,261 | A | 9/1999 | Hay et al. | |
| 6,341,397 | B1 | 1/2002 | Kliegl et al. | |
| 6,499,165 | B1 | 12/2002 | Morgillo | |
| 6,640,340 | B2 | 11/2003 | Gibson | |
| 6,662,390 | B1 | 12/2003 | Berger | |
| 6,839,924 | B2 | 1/2005 | Sims | |
| 6,868,566 | B2 | 3/2005 | Gatten | |
| 6,928,674 | B2 | 8/2005 | Blackburn | |
| D513,357 | S | 1/2006 | Allard | |
| 7,043,783 | B2 | 5/2006 | Gatten | |
| 7,076,819 | B2 | 7/2006 | Trani et al. | |
| 7,181,789 | B2 | 2/2007 | Gatten | |
| 7,774,875 | B1 * | 8/2010 | Zeidman | 5/494 |
| 2007/0157392 | A1 * | 7/2007 | Ragen | 5/655 |
| 2010/0257653 | A1 * | 10/2010 | Pitts | 2/69.5 |

* cited by examiner

*Primary Examiner* — Robert G Santos
*Assistant Examiner* — Nicholas Polito
(74) *Attorney, Agent, or Firm* — Law Offices of Steven W. Weinrieb

(57) ABSTRACT

A swaddling blanket for infants, particularly newborn infants, and more particularly for premature infants, comprises an inner blanket and an outer blanket. Each of the inner and outer blankets comprises three flap members such that when all three flap members of the inner blanket, and all three flap members of the outer blanket, are folded over the infant, the infant is comfortably enclosed within six blanket layers in order to provide the infant with the requisite amount of warmth. The baby is also placed upon a support cushion effectively built into the swaddling blanket such that the baby's head, neck, and spinal regions are adequately supported.

13 Claims, 3 Drawing Sheets

SWADDLING BLANKET, PATICULARLY FOR USE IN CONNECTION WITH PREMATURE INFANTS, AND METHOD OF USING THE SAME

FIELD OF THE INVENTION

The present invention relates generally to swaddling blankets, and more particularly to a new and improved swaddling blanket which is not only intended for use in connection with all newborn or young infants, but in particular, for use in connection with the swaddling of premature infants. More specifically, the swaddling blanket of the present invention effectively comprises an inner blanket and an outer blanket. The outer blanket preferably has, for example, a substantially diamond-shaped configuration, and a support cushion, which may have, for example, a substantially elliptical configuration and which is fabricated from a suitable foam, such as, for example, compressed polyester which has or exhibits a predetermined degree of cushioning and rigidity, is placed inside a pouch which may also have a substantially complementary elliptical configuration and which is open at its upper portion so as to enable the cushion to be placed inside the pouch. The pouch is fixedly secured upon its other three side edge portions to an upper corner region of the outer blanket so as to thus support the entire body of the infant, including the head, neck, torso, and legs of the infant, in a cushioned manner. The disposition of the foam, within the pouch upon which the infant is disposed, enables the entire infant to be desirably cushioned, for comfort, and also effectively serves as a spinal type support whereby the infant can be properly supported, particularly with respect to its head, neck, and spinal regions. This is very important in connection with, for example, relatively newborn infants, particularly when, for example, the infant is to be subsequently picked up and held within one's arms at which time it is particularly important to adequately support the infant's head and neck such that, for example, the head does not roll or fall backwardly, potentially injuring the neck and upper spinal regions of the infant's body.

The inner blanket effectively comprises three flap members, a bottom flap member, a left side flap member, and a right side flap member, respectively secured to the lower end portion of the pouch, the left side portion of the pouch, and the right side portion of the pouch, at the respective interfaces where the three side portions of the pouch are secured to the outer blanket. In use, the infant is placed upon the support cushion, the lower flap member of the inner blanket is folded upwardly so as to cover the entire body of the infant whereby the upper edge portion of the lower flap member effectively covers the neck of the infant and is disposed just below the chin of the infant. The left and right side portions of the lower flap member are then respectively tucked beneath the right and left side body portions of the infant, the left side flap member of the inner blanket is then folded over the torso of the infant and then likewise tucked beneath the left side body portion of the infant, and subsequently, the right side flap member of the inner blanket is folded over the torso of the infant so as to likewise be tucked beneath the right side body portion of the infant. Suitable fasteners, such as, for example, VELCRO® or the like may be used to secure the flaps at their desired positions or locations. The bottom flap member or corner, the left side flap member or corner, and the right side flap member or corner of the outer blanket are then respectively folded over the infant in a similar manner as were the flap members of the inner blanket, and in this manner, the infant is encased within the swaddling blanket which now effectively comprises six blanket layers covering the entire body of the infant except, of course, the infant's head. Accordingly, the infant, particularly in the case of a premature infant, is provided with the requisite amount of warmth.

BACKGROUND OF THE INVENTION

The swaddling of infants is a well-known technique that has been used extensively in the past for a multitude of reasons. According to various health care specialists, the use of swaddling blankets, to implement the technique of swaddling, is quite beneficial to the infant for a variety of reasons. For example, swaddling blankets protect the infant from the surrounding environment, particularly in connection with ambient temperatures, that is, the swaddling blanket is a beneficial means for maintaining the infant in a warm yet comfortable environment. In addition, swaddling blankets permit caregivers to easily handle and carry an infant, as well as to help soothe the infant and to maintain the infant comfortable, quiet, and calm. Furthermore, swaddling blankets facilitate the needed sleeping of the infants, particularly on their backs, which significantly reduces their vulnerability to Sudden Infant Death Syndrome (SIDS). Still further, the use of swaddling blankets are surmised to effectively simulate the pre-birth womb environment where the infant effectively experiences an environment of warmth, safety, security, and general well-being.

Numerous swaddling blankets are of course known and are exemplified by means of U.S. Pat. No. 7,181,789 which issued to Gatten on Feb. 27, 2007, U.S. Pat. No. 7,076,819 which issued of Trani et al. on Jul. 18, 2006, U.S. Pat. No. 7,043,783 which issued to Gatten on May 16, 2006, U.S. Pat. No. 6,928,674 which issued to Blackburn on Aug. 16, 2005, U.S. Pat. No. 6,868,566 which issued to Gatten on Mar. 22, 2005, U.S. Pat. No. 6,839,924 which issued to Sims on Jan. 11, 2005, U.S. Pat. No. 6,662,390 which issued to Berger on Dec. 16, 2003, U.S. Pat. No. 6,640,340 which issued to Gibson on Nov. 4, 2003, U.S. Pat. No. 6,499,165 which issued to Morgillo on Dec. 31, 2002, U.S. Pat. No. 6,341,397 which issued to Kliegl et al. on Jan. 29, 2002, U.S. Pat. No. 5,950,261 which issued to Hay et al. on Sep. 14, 1999, U.S. Pat. No. 5,781,946 which issued to McEntire et al. on Jul. 21, 1998, U.S. Pat. No. 5,722,094 which issued to Ruefer on Mar. 3, 1998, U.S. Pat. No. 5,692,257 which issued to Albertieri on Dec. 2, 1997, U.S. Pat. No. 4,979,250 which issued to Troncone et al. on Dec. 25, 1990, U.S. Pat. No. 3,477,065 which issued to Hoover on Nov. 11, 1969, U.S. Pat. No. 3,412,407 which issued to Key on Nov. 26, 1968, U.S. Pat. No. 2,227,751 which issued to Idelman on Jan. 7, 1941, U.S. Pat. No. 1,584,853 which issued to Dern on May 18, 1926, U.S. Pat. No. 1,583,419 which issued to Perl on May 4, 1926, United States Patent Application Publication 2007/0157392 which issued to Ragen on Jul. 12, 2007, and U.S. Design Pat. D513,357 which issued to Allard on Jan. 3, 2006.

To be effective, it is known that swaddling blankets need to be substantially snug yet not, obviously, so tight as to effectively be suffocating. Thin blankets may provide insufficient insulation to maintain the proper body heat and body temperature for the infant, whereas heavy blankets may in fact cause overheating of the infant. It is also desired, and very important, to adequately support the head and neck regions of the infant, particularly when they are being picked up from a supine position so as to be cradled or held within one's arms, otherwise serious injury to the infant's neck and spine regions may occur. While all of the aforenoted swaddling blankets discloses various designs for their swaddling blankets, means for folding their swaddling blankets in particular modes, means for fastening the various elements or components of the swaddling blankets together, none of the noted prior art discloses a swaddling blanket which can not only provide means for adequately supporting the swaddled infant such that, in particular, the head and neck regions of the infant's body are in fact assuredly supported so as not to impart any potential injury thereto, but in addition, to also exhibit the other necessary characteristics of the swaddling blanket, such as, for example, general protection and snugness, and particularly warmth of the infant. This is particularly critical in the case of, for example, premature babies.

One of the biggest challenges facing a premature baby is that of warmth. Warmth is essential to premature babies because it helps fight off infection especially considering the fact that premature babies effectively have underdeveloped immune systems. In addition, warmth permits premature babies to use energy more efficiently which, in the case of premature babies, permits them to use energy for need development. A baby that is not warm enough will tend to shiver which uses a lot of energy which effectively depletes their energy levels, or considered from a different point of view, such energy could otherwise be used for development. It is known, for example, that when babies are being naturally developed as a result of being within the womb during the last weeks of pregnancy, that is the time when babies normally develop their protective layer of body fat, however, as a result of being born premature, they obviously do not have that time to develop their normal level of body fat. Accordingly, they do not have a sufficient layer of body fat to normally maintain their own body temperature. This is why a baby, born before it has achieved its substantially full term of pregnancy, is placed within an incubator so as to effectively simulate the mother's womb in terms of warmth and isolation from germs.

It is also known that skin-to-skin contact is extremely important to premature babies in order to promote brain development as well as for soothing purposes. In order to provide premature babies with such needed skin-to-skin contact, nurses in the neonatal intensive care unit (NICU) must first wrap the baby in numerous blanket layers in order to maintain their body temperature before, for example, giving the baby to its mother or father. However, it is sometimes difficult to maintain the various blankets securely wrapped about the baby, or to enable one to properly support the baby while the baby is being picked up, transferred from, for example, one of the NICU nurses to one of the parents, and subsequently held by one of the parents.

A need therefore exists in the art for a new and improved swaddling blanket wherein, in addition to the normal functions of a swaddling blanket, the swaddling blanket needs to be provided with a multitude of blanket layers for not only supporting the swaddled infant such that, in particular, the head and neck regions of the infant's body are in fact adequately supported, but in addition, the requisite amount of warmth is provided to the infant, particularly in the case of premature babies.

SUMMARY OF THE INVENTION

The foregoing and other objectives are achieved in accordance with the teachings and principles of the present invention through the provision of a new and improved swaddling blanket which is not only intended for use in connection with all newborn or young infants, but in particular, for use in connection with the swaddling of premature infants. More specifically, the swaddling blanket of the pre-sent invention effectively comprises an inner blanket and an outer blanket. The outer blanket preferably has, for example, a substantially diamond-shaped configuration, and a support cushion, which may have, for example, a substantially elliptical configuration and which is fabricated from a suitable foam, such as, for example, compressed polyester which has or exhibits a predetermined degree of cushioning and rigidity, is placed inside a pouch which may also have a substantially complementary elliptical configuration and which is open at its upper portion so as to enable the cushion to be placed inside the pouch. The pouch is fixedly secured upon its other three side edge portions to an upper corner region of the outer blanket so as to thus support the entire body of the infant, including the head, neck, torso, and legs of the infant, in a cushioned manner. The disposition of the foam, within the pouch upon which the infant is disposed, enables the entire infant to be desirably cushioned, for comfort, and also effectively serves as a spinal type support whereby the infant can be properly supported, particularly with respect to its head, neck, and spinal regions. This is very important in connection with, for example, relatively newborn infants, particularly when, for example, the infant is to be subsequently picked up and held within one's arms at which time it is particularly important to adequately support the infant's head and neck such that, for example, the head does not roll or fall backwardly, potentially injuring the neck and upper spinal regions of the infant's body.

The inner blanket effectively comprises three flap members, a bottom flap member, a left side flap member, and a right side flap member, respectively secured to the lower end portion of the pouch, the left side portion of the pouch, and the right side portion of the pouch, at the respective interfaces where the three side portions of the pouch are secured to the outer blanket. In use, the infant is placed upon the support cushion, the lower flap member of the inner blanket is folded upwardly so as to cover the entire body of the infant whereby the upper edge portion of the lower flap member effectively covers the neck of the infant and is disposed just below the chin of the infant. The left and right side portions of the lower flap member are then respectively tucked beneath the right and left side body portions of the infant, the left side flap member of the inner blanket is then folded over the torso of the infant and then likewise tucked beneath the left side body portion of the infant, and subsequently, the right side flap member of the inner blanket is folded over the torso of the infant so as to likewise be tucked beneath the right side body portion of the infant. Suitable fasteners, such as, for example, VELCRO® or the like may be used to secure the flaps at their desired positions or locations. The bottom flap member or corner, the left side flap member or corner, and the right side flap member or corner of the outer blanket are then respectively folded over the infant in a similar manner as were the flap members of the inner blanket, and in this manner, the infant is encased within the swaddling blanket which now effectively comprises six blanket layers covering the entire body of the infant except, of course, the infant's head. Accordingly, the infant, particularly in the case of a premature infant, is pro-vided with the requisite amount of warmth.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
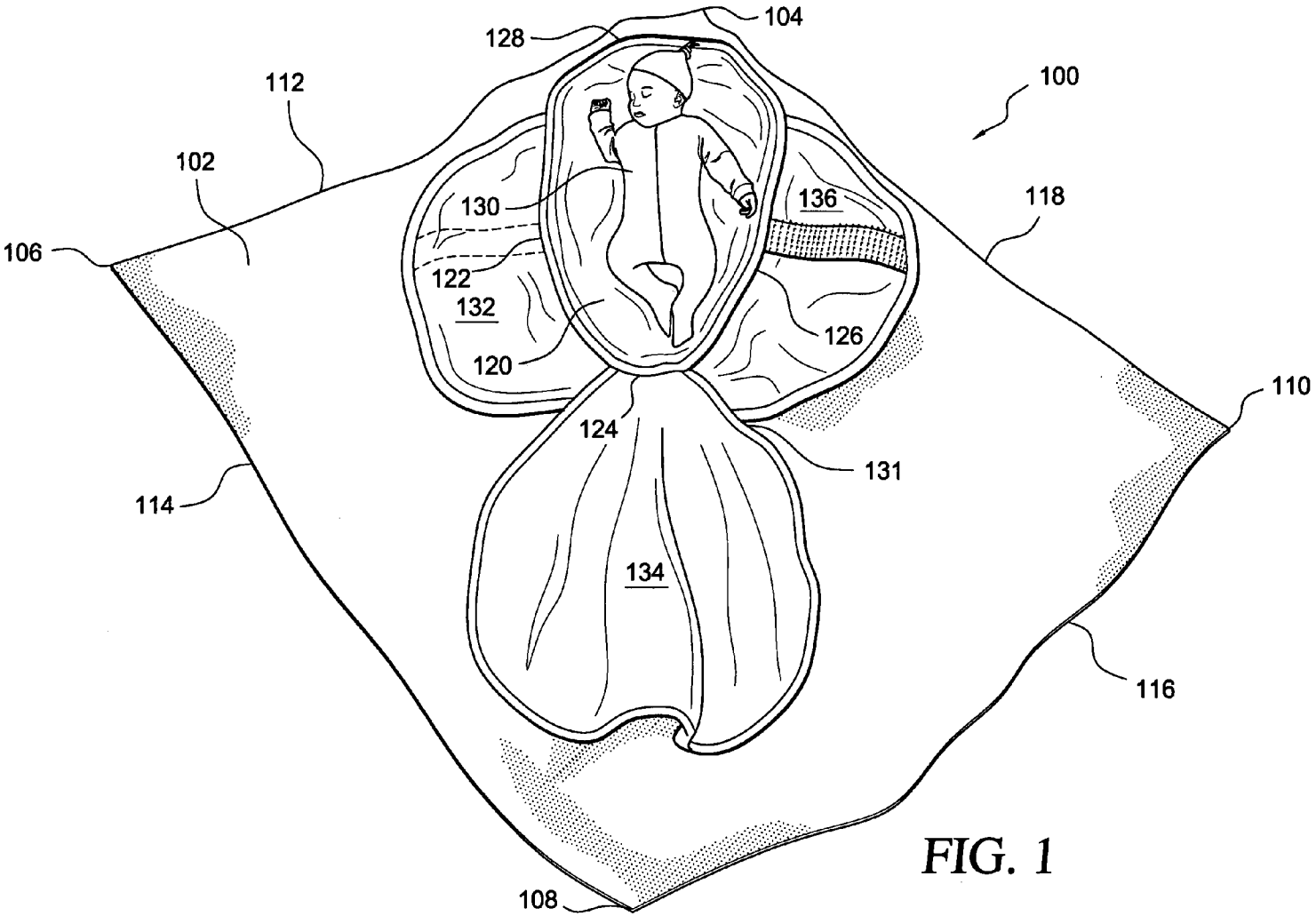
FIG. 1 is a top plan perspective view showing the new and improved swaddling blanket as constructed in accordance with the principles and teachings of the present invention wherein the swaddling blanket is clearly illustrated as comprising the cushioned support pad fixedly secured to the upper corner region of the outer blanket and upon which the infant is placed, the three flap members respectively secured to the left side portion of the cushioned support pad, the lower or bottom portion of the cushioned support pad, and the right side portion of the cushioned pad so as to effectively form the three-layered inner blanket, and the outer blanket, upon which the cushioned support pad and the three flap members comprising the inner blanket are fixedly secured and which also effectively define a three-layered outer blanket when the left side, bottom, and right side flap members, comprising the remaining corner regions of the outer blanket, are folded over the infant.
Figure 2:
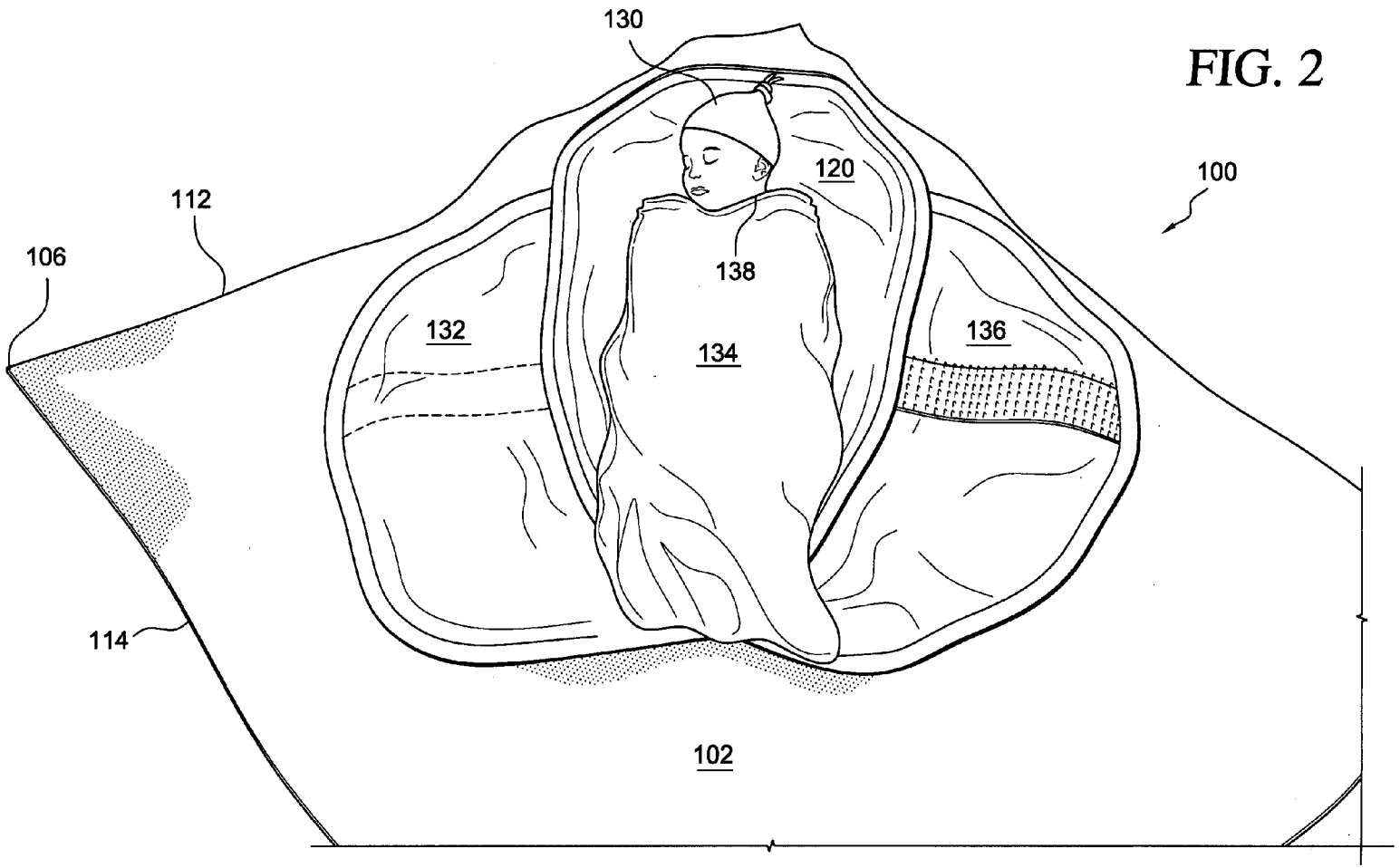
FIG. 2 is a top plan perspective view similar to that of FIG. 1, showing however the lower flap member of the inner blanket being folded upwardly so as to cover the entire body of the infant, except for the head of the infant, and wherein the right and left side edge portions of the lower flap member have been respectively tucked beneath the left and right side body portions of the infant.
Figure 3:
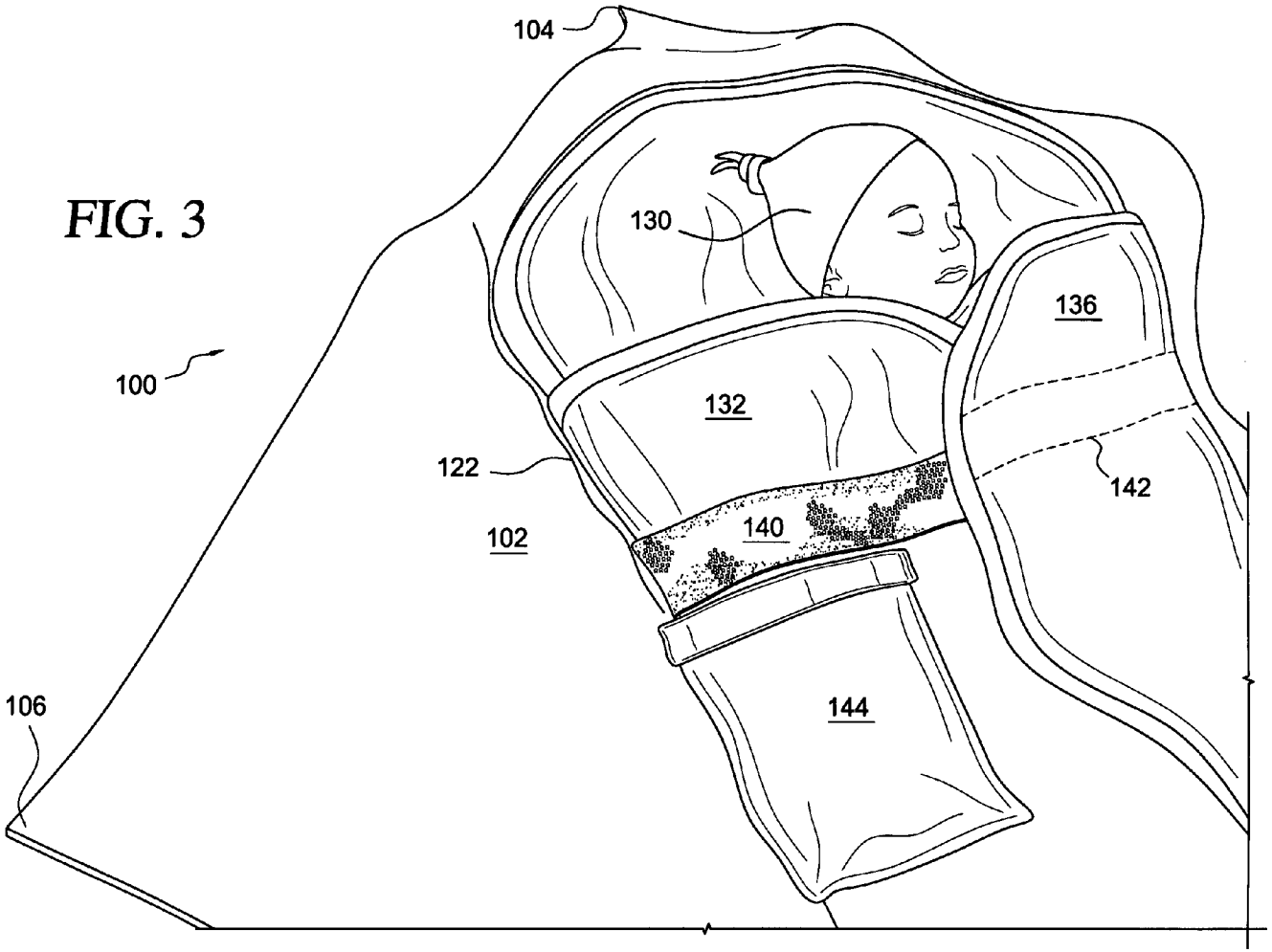
FIG. 3 is a top plan perspective view similar to those of FIGS. 1 and 2 showing, however, the left and right side flap members of the inner blanket folded over the entire body portion of the infant except, of course, the head of the infant.

Referring now to the drawings, and more particularly to FIGS. 1-3 thereof, it is seen that the new and improvised swaddling blanket, constructed in accordance with the principles and teachings of the present invention, is disclosed and is generally indicated by the reference character 100. More particularly, it is seen that the swaddling blanket 100 is seen to comprise a base or outer blanket 102 which may have, for example, a substantially square or diamond-shaped configuration comprising four corner regions 104,106, 108,110 and four side edge portions 112,114,116,118 defining the aforenoted corner regions 104,106,108,110. A support pouch 120, which may have, for example, a substantially elliptical configuration, is fixedly secured, such as, for example, by means of sewn stitching, to the upper or inner surface portion of the blanket 102 and within the upper corner region 104 of the blanket 102, wherein the support pouch 120 is adapted to be closed upon its left, bottom, and right side portions 122, 124,126 thereof so as to effectively define a pouch enclosure, while the upper side portion 128 of the pouch remains open so as to effectively define an opening into which a suitable support cushion, not visible, having a substantially elliptical con-figuration corresponding to that of the support pouch 120, can be inserted. The support cushion may be fabricated from a suitable foam material, such as, for example, compressed polyester, and the length and width dimensions of the support pouch 120 are large enough such that the entire body of an infant 130 is able to be accommodated upon the support pouch 120 when the infant is placed upon the support pouch 120. The provision of the support cushion, not visible, within the support pouch 120 thus provides cushioned support for the entire body of the infant, and in addition, since the foam material, comprising, for example, the compressed polyester, exhibits a predeterminedly desired amount of rigidity, the entire body of the infant, particularly the spine, neck, and head portions, is also adequately supported such that, for example, when the baby is picked up from the illustrated supine position, the head and neck portions of the infant do not roll or fall backwardly which can be very injurious to an infant, particularly to a relatively newborn infant.

Continuing further, and as has been noted hereinbefore, it is especially desirable in connection with infants, and in particular in connection with a newborn infant, and in particular still further, in connection with a premature infant, that the infant is maintained in a comfortably warm state. To this end, the swaddling blanket 100 of the present invention comprises unique structural components. More particularly, it is seen that the swaddling blanket 100 effectively comprises an inner blanket in addition to the base or outer blanket 102. The inner blanket 131 is effectively defined or formed by means of three flap members 132,134,136 which are respectively secured, such as, for example, by means of sewn stitching, to substantially central regions upon the inner surface portion of the base or outer blanket 102 and more particularly at the interfaces at which the left side portion 122, the bottom side portion 124, and the right side portion 126 of the support pouch 120 are also secured to the base or outer blanket 102. In addition, it is particularly noted the longitudinal extents of the laterally spaced and oppositely disposed left and right side flap members 132,136 of the inner blanket 131 correspond substantially to the longitudinal extents of the laterally spaced and oppositely disposed left and right side portions 122,126 of the support pouch 120, or alternatively, at least have longitudinal extents which are longer than the average length of a newborn or relatively young infant. Accordingly, as can best be seen from FIGS. 2 and 3, after the infant has been placed upon the support pouch 120, as disclosed within FIG. 1, and it is desired to begin wrapping the infant within the swaddling blanket 100, the bottom flap member 134 of the inner blanket 131 is folded upwardly as shown in FIG. 2 such that an upper edge portion 138 of the bottom flap member 134, that has been formed by effectively folding the bottom flap member 134 accordingly as may be necessary, effectively covers the neck region of the infant and is disposed adjacent to the infant's chin.

In addition, the left and right side portions of the bottom flap member 134 are also respectively tucked beneath the right and left side body portions of the infant 130. Subsequently, as can best be appreciated from FIG. 3, the left flap member 132 of the inner blanket 131 is folded over the infant's torso from left to right, and the right flap member 136 of the inner blanket 131 is subsequently folded over the infant's torso from right to left so as to in fact be disposed atop the folded left flap member 132. It is to be noted that the fact that each of the flap members 132, 136 has a longitudinal extent which substantially corresponds to the longitudinal extents of the left and right side portions 122,126 of the support pouch 120 enables the left and right side flap members 122,126 to completely cover the entire body portion of the infant 130 except, of course, the head of the infant. Suitable fastener means, such as, for example, VELCRO® strips 140,142 may be provided upon the back, lower, or outer surface portion of the left flap member 132 as considered relative to the infant, and upon the front, upper, or inner surface portion of the right flap member 136, as considered relative to the infant and as viewed within FIGS. 2 and 3, such that they may be fastened or secured together in order to completely secure the infant within the inner blanket 131 as shown within FIG. 3.

Subsequently still further, in order to complete the entire wrapping of the infant within the swaddling blanket 100, and with reference reverting back to FIG. 1, the lower corner or flap member 108 of the base or outer blanket 102 is folded upwardly in a manner similar to the upward folding of the lower or bottom flap member 134 of the inner blanket 131, the left side corner or flap member 106 of the base or outer blanket 102 is then folded over the infant's torso from left to right, and finally the right side corner or flap member 110 of the base or outer blanket 102 is folded over the infant's torso from right to left, it being understood that the left and right corner or flap members 106,110 of the base or outer blanket 102 may be provided with suitable fasteners, such as, for example, VELCRO® strips, not shown, but similar to the VELCRO® strips 140,142 provided upon the outer and inner surface portions of the left and right side flap members 132, 136 of the inner blanket 131, in order to secure the left and right side corner or flap members 106,110 of the base or outer blanket 102 together. As a result of this folding of the three corner or flap members 106,108,110 of the outer blanket 102, it can be readily appreciated that the infant is now comfortably enclosed within a dual-layered swaddling blanket 100 comprising the inner blanket layer 131 and the outer blanket layer 102, and wherein each blanket layer 102,131 itself, that is, the inner blanket layer 131 and the outer blanket layer 102, comprises three layers defined by means of the three members or flaps 132,134,136 comprising the inner blanket 131, and the three corners or flaps 106,108,110 comprising the outer blanket 102, thereby providing the infant with the requisite amount of comfort and warmth.

It is lastly seen, with reference being made to FIG. 3, that the back or bottom surface of the left side flap member 132 may optionally be provided with a pocket 144. The pocket 144 is adapted to house a sound reproducing device or mechanism such as, for example, one similar to that disclosed within U.S. Pat. No. 5,063,912 which issued to Hughes on Nov. 12, 1991. The device can be any currently available sound reproducing mechanism such as, for example, a cassette player, a CD player, an iPod, or the like. The sound reproducing device or mechanism, as disclosed within the aforenoted patent, can reproduce or generate sounds similar or corresponding to those heard by an infant within the mother's womb so as to placate the infant and, for example, help induce sleep.

Thus, it may be seen that in accordance with the principles and teachings of the present invention, there has been disclosed a new and improved swaddling blanket, particularly for infants, particularly for newborn infants, and more particularly for premature infants, wherein the same comprises an inner blanket and an outer blanket. The outer blanket preferably has, for example, a substantially diamond-shaped configuration, and a support cushion, which may have, for example, a substantially elliptical configuration and which is fabricated from a suitable foam, such as, for example, compressed polyester which has or exhibits a predetermined degree of cushioning and rigidity, is placed inside a pouch which may also have a substantially complementary elliptical configuration and which is open at its upper portion so as to enable the cushion to be placed inside the pouch. The pouch is fixedly secured upon its other three side edge portions to an upper corner region of the outer blanket so as to thus support the entire body of the infant, including the head, neck, torso, and legs of the infant, in a cushioned manner. The disposition of the foam, within the pouch upon which the infant is disposed, enables the entire infant to be desirably cushioned, for comfort, and also effectively serves as a spinal type support whereby the infant can be properly supported, particularly with respect to its head, neck, and spinal regions. This is very important in connection with, for example, relatively newborn infants, particularly when, for example, the infant is to be subsequently picked up and held within one's arms at which time it is particularly important to adequately support the infant's head and neck such that, for example, the head does not roll or fall backwardly, potentially injuring the neck and upper spinal regions of the infant's body.

The inner blanket effectively comprises three flap members, a bottom flap member, a left side flap member, and a right side flap member, respectively secured to the lower end portion of the pouch, the left side portion of the pouch, and the right side portion of the pouch, at the respective interfaces where the three side portions of the pouch are secured to the outer blanket. In use, the infant is placed upon the support cushion, the lower flap member of the inner blanket is folded upwardly so as to cover the entire body of the infant whereby the upper edge portion of the lower flap member effectively covers the neck of the infant and is disposed just below the chin of the infant. The left and right side portions of the lower flap member are then respectively tucked beneath the right and left side body portions of the infant, the left side flap member of the inner blanket is then folded over the torso of the infant and then likewise tucked beneath the left side body portion of the infant, and subsequently, the right side flap member of the inner blanket is folded over the torso of the infant so as to likewise be tucked beneath the right side body portion of the infant. Suitable fasteners, such as, for example, VELCRO® or the like may be used to secure the flaps at their desired positions or locations. The bottom flap member or corner, the left side flap member or corner, and the right side flap member or corner of the outer blanket are then respectively folded over the infant in a similar manner as were the flap members of the inner blanket, and in this manner, the infant is encased within the swaddling blanket which now effectively comprises six blanket layers covering the entire body of the infant except, of course, the infant's head. Accordingly, the infant, particularly in the case of a premature infant, is provided with the requisite amount of warmth.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A swaddling blanket, comprising:

a base outer blanket having a substantially square-shaped configuration defined by four corner flap members and four side edge portions connecting said four corner flap members together, inner and outer surface portions, and a space defined upon an inner surface portion of an upper one of said four corner flap members upon which an infant is to be placed, whereby the remaining three corner flap members of said outer blanket define a lower corner flap member, a left side corner flap member, and a right side corner flap member;

an inner blanket fixedly secured to said inner surface portion of said outer blanket within a substantially central region of said outer blanket adjacent to said space defined upon said inner surface portion of said upper one of said four corner flap members upon which the infant is to be placed so as to effectively surround said space upon which the infant is to be placed;

wherein said inner blanket comprises three blanket flap members comprising a bottom flap member and a pair of laterally spaced left and right side flap members, which are adapted to be sequentially folded over the infant when the infant is placed upon said inner surface portion of said upper one of said four corner flap members of said outer blanket; and wherein further, said three remaining corner flap members of said four corner flap members of said outer blanket, aside from said upper one of said four corner flap members of said outer blanket upon which the infant is to be placed, are adapted to be sequentially folded over said three blanket flap members of said inner blanket, which have been sequentially folded over the infant, such that the infant is enclosed within a dual-layer blanket comprising said inner and outer blankets, wherein each one of said inner and outer blankets, comprising said dual-layer blanket, comprises a three-layer blanket assembly formed by said three blanket flap members of said inner blanket and said three corner flap members of said outer blanket whereby the infant is enclosed within six layers of said swaddling blanket so as to be provided with the requisite amount of warmth.

2. The swaddling blanket as set forth in claim 1, further comprising:

a cushioned support fixedly secured within said space defined upon said inner surface portion of said one of said four corner flap members of said outer blanket so as to support the infant thereon.

3. The swaddling blanket as set forth in claim 2, wherein said cushioned support comprises:

a cushioned pouch having an opening defined along one edge portion thereof; and a support cushion disposed internally within said cushioned pouch, as a result of being inserted through said opening defined along said one edge portion of said cushioned pouch, so as to provide said cushioned pouch of said cushioned support with a requisite amount of cushioned support for the infant as well as a predetermined amount of rigidity for the infant in order to adequately support the infant's head, neck, and spinal regions.

4. The swaddling blanket as set forth in claim 3, wherein: said support cushion is fabricated from compressed polyester.

5. The swaddling blanket as set forth in claim 2, wherein: said cushioned support has predetermined length and width dimensions which are large enough to accommodate the entire body portion of the infant when the infant is placed upon said cushioned pouch.

6. The swaddling blanket as set forth in claim 5, wherein: said three blanket flap members of said inner blanket comprise a bottom flap member fixedly secured to a lower end portion of said cushioned support, and a pair of oppositely disposed left and right side flap members fixedly secured respectively to left and right side portions of said cushioned support.

7. The swaddling blanket as set forth in claim 6, wherein: the longitudinal extents of said left and right side flap members of said inner blanket substantially correspond to the longitudinal extents of said left and right side portions of said cushioned support so as to completely cover the entire body portion of the infant when said left and right side flap members of said inner blanket are folded over the body portion of the infant.

8. The swaddling blanket as set forth in claim 2, wherein: said three flap members of said inner blanket are fixedly secured to said inner surface portion of said outer blanket at interfaces at which three edge portions of said cushioned support are fixedly secured to said inner surface portion of said outer blanket.

9. The swaddling blanket as set forth in claim 1, further comprising:

fastener means disposed upon said flap members of said inner blanket for securing said flap members of said inner blanket together about the body of the infant when said flap members of said inner blanket are folded over with respect to the infant and with respect to each other.

10. The swaddling blanket as set forth in claim 9, wherein: said fastener means comprise hook and loop strips.

11. The swaddling blanket as set forth in claim 1, further comprising:

fastener means disposed upon said corner flap members of said outer blanket for securing said corner flap members of said outer blanket together about the body of the infant when said corner flap members of said outer blanket are folded over with respect to the infant and with respect to each other.

12. The swaddling blanket as set forth in claim 11, wherein: said fastener means comprise hook and loop strips.

13. The swaddling blanket as set forth in claim 1, further comprising:

pocket means fixedly secured upon one of said three blanket flap members of said inner blanket for housing a sound reproducing mechanism for generating soothing sounds to the infant which simulate sounds of the womb.

* * * * *